US007721568B1

(12) United States Patent
Grutza, Jr.

(10) Patent No.: US 7,721,568 B1
(45) Date of Patent: May 25, 2010

(54) REFRIGERATOR UNIT BEVERAGE TAPPER CONVERSION KIT

(76) Inventor: Robert J. Grutza, Jr., 1123 Breckenridge Ave., Lake Forest, IL (US) 60045

( * ) Notice: Subject to any disclaimer, the term of this patent is extended or adjusted under 35 U.S.C. 154(b) by 280 days.

(21) Appl. No.: 11/852,356

(22) Filed: Sep. 10, 2007

(51) Int. Cl.
*F25D 3/00* (2006.01)

(52) U.S. Cl. ..... 62/389; 62/298; 62/299; 62/326; 312/405; 312/406.2; 222/183

(58) Field of Classification Search ..... 62/389, 62/298–299, 259.1; 312/401, 405, 265.6; 222/399, 146.6, 609, 183, 173, 129.1, 129.2, 222/131, 400.7, 325
See application file for complete search history.

(56) References Cited

U.S. PATENT DOCUMENTS

| | | | | |
|---|---|---|---|---|
| 2,263,071 | A * | 11/1941 | Darbyshire | 220/592.06 |
| 4,901,887 | A | 2/1990 | Burton | |
| 4,979,647 | A | 12/1990 | Hassell | |
| 6,375,048 | B1 * | 4/2002 | van der Meer et al. | 222/396 |
| 2002/0153817 | A1 * | 10/2002 | Wenning et al. | 312/406 |

FOREIGN PATENT DOCUMENTS

| | | |
|---|---|---|
| DE | 102005060762 | * 12/2005 |
| JP | 2003-3276768 | * 10/2003 |

OTHER PUBLICATIONS

Kegerator Conversion Kit, Beverage Factory. com, 2006, www. beveragefactory.com/images/conversion-kit-manual.pdf, entire document.*

* cited by examiner

*Primary Examiner*—Frantz F Jules
*Assistant Examiner*—Cassey Bauer
(74) *Attorney, Agent, or Firm*—Donald J. Ersler

(57) ABSTRACT

A refrigerator unit beverage tapper conversion kit includes a door cover. The door cover includes a nylon sheet sewn into the shape of a generally concave cap. The regular door is replaced with the door cover. At least one insulating layer is attached to an inside surface of the cap. An inside perimeter of the door cover is sized to be slipped over an outside perimeter of an open end of the refrigerator unit. An elastic loop is retained on an open perimeter of the door cover for sealing an open end of the refrigerator unit. The refrigerator unit beverage tapper conversion kit may also include a carbon dioxide bottle, a gas regulator, a sankey, a faucet support, a faucet, a faucet shank, a carbon dioxide tube and a beverage tube. The faucet is disposed on the refrigerator door cover for dispensing a beverage in a half barrel.

16 Claims, 3 Drawing Sheets

REFRIGERATOR UNIT BEVERAGE TAPPER CONVERSION KIT

BACKGROUND OF THE INVENTION

1. Field of the Invention

The present invention relates generally to refrigeration and more specifically to a refrigerator unit beverage tapper conversion kit, which allows a refrigerator unit to be converted into a beverage tapper.

2. Discussion of the Prior Art

Refrigerator units include any structure that cools or keeps cool some object placed therein. Particularly, mini-refrigerators are very convenient for storing items that need to be refrigerated, where space does not allow for a normal size refrigerator. However, a half barrel is just slightly to big to be retained in a mini-refrigerator. U.S. Pat. No. 4,901,887 to Burton discloses a beverage dispensing system. The Burton patent includes a beverage dispensing system, which utilizes a modified refrigerator/freezer unit and a tower mounted on a top of the refrigerator. U.S. Pat. No. 4,979,647 to Hassell discloses a method and apparatus for cooling and dispensing beverage. The Hassell patent includes a beverage cooling, carbonating and dispensing apparatus, which has a refrigerator cabinet having a cold air cooling chamber, a cold beverage reservoir and carbonator in the cooling chamber, an outlet from the reservoir to a dispensing valve, and a spring-like helically coiled thermally conductive precooler secured to a beverage inlet of the reservoir.

Accordingly, there is a clearly felt need in the art for a refrigerator unit beverage tapper conversion kit, which allows a half barrel to be stored in a refrigerator unit by replacing the door with a door cover.

SUMMARY OF THE INVENTION

The present invention provides a refrigerator unit beverage tapper conversion kit, which allows a refrigerator unit to be converted into a beverage tapper. The refrigerator unit beverage tapper conversion kit (refrigerator conversion kit) includes a door cover. The door cover preferably includes a nylon sheet that is sewn into the shape of a cap. An insulating layer is attached to an inside surface of the cap. An inside perimeter of the cap is sized to be slipped over an outside perimeter of an open end of the refrigerator unit. An elastic loop is sewn on an open end perimeter of the cap for sealing to an outside perimeter of an open end of the refrigerator. The elastic loop may be cut and a draw string inserted into the elastic loop, such that each end of the draw string extends from the cut. A shank opening is formed through a front of the door cover to provide clearance for a faucet shank.

The refrigerator conversion kit may also include a carbon dioxide bottle, a gas regulator, a sankey, a faucet support, a faucet, a faucet shank, a carbon dioxide tube and a beverage tube. The carbon dioxide bottle is filled with pressurized carbon dioxide gas. The regulator is attached to a top of the carbon dioxide bottle. The sankey is inserted into a top of a half barrel of some beverage. One end of the carbon dioxide tube is connected to an output of the gas regulator and the other end is connected to an input of the sankey.

A regular door is removed from the refrigerator unit, before installing the door cover. The elastic loop is slipped over the open end of the refrigerator unit. If a draw string is used, then the draw string is pulled tightly and tied to maintain a substantially air tight seal between the door cover and the open end of the refrigerator unit. The faucet support is attached to a top of the half barrel. The faucet shank is inserted through a support plate and through the shank opening. One end of the faucet shank is secured to an end of the faucet support. The faucet is secured to the other end of the faucet shank. One end of the beverage tube is connected to an outlet of the sankey and the other end is connected to the faucet shank. Pulling a handle of the faucet provides a refrigerated beverage from the half barrel.

Accordingly, it is an object of the present invention to provide a refrigerator conversion kit, which allows a refrigerator unit to be converted into a beverage tapper by replacing the door with a door cover.

These and additional objects, advantages, features and benefits of the present invention will become apparent from the following specification.

DETAILED DESCRIPTION OF THE PREFERRED EMBODIMENTS

Figure 1:
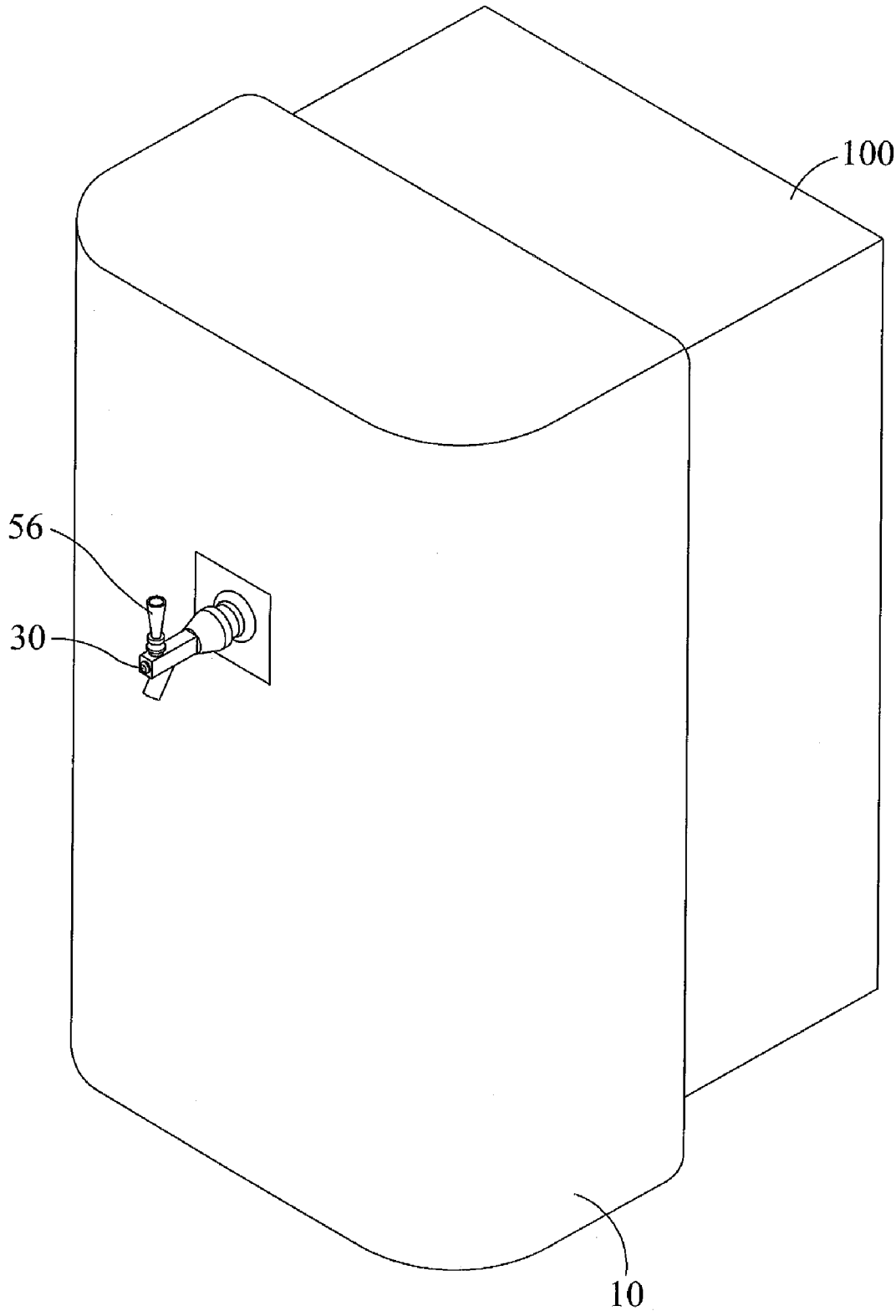
FIG. 1 is a perspective view of a refrigerator unit with a door cover replacing the regular door of the refrigerator unit in accordance with the present invention.
Figure 2:
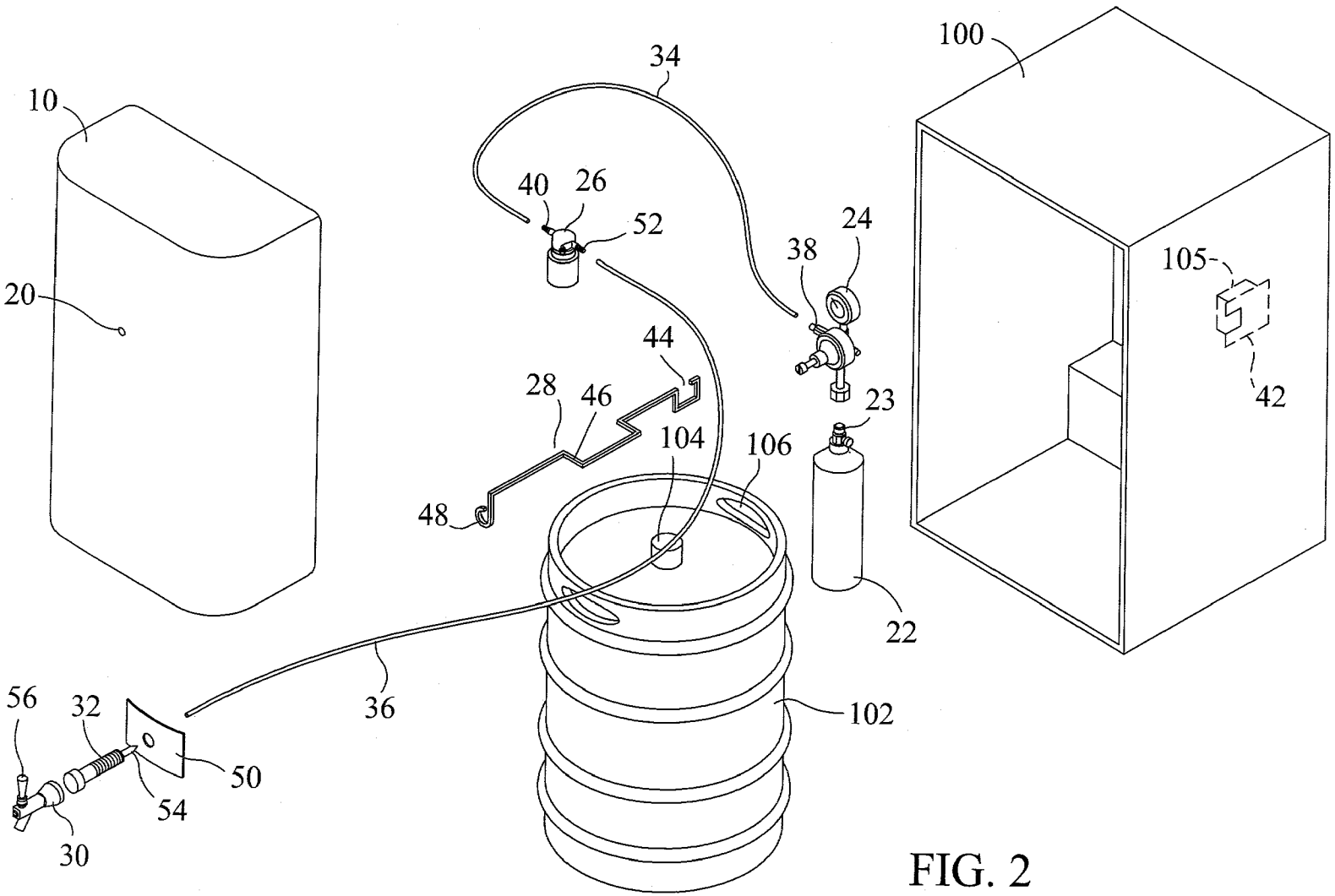
FIG. 2 is an exploded perspective view of a refrigerator unit and a refrigerator conversion kit in accordance with the present invention.
Figure 4:
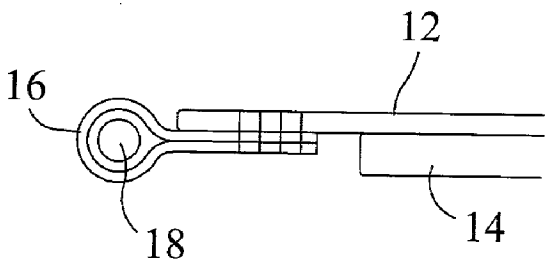
FIG. 4 is an enlarged cross sectional view of a door cover of a refrigerator conversion kit in accordance with the present invention.
Figure 3:
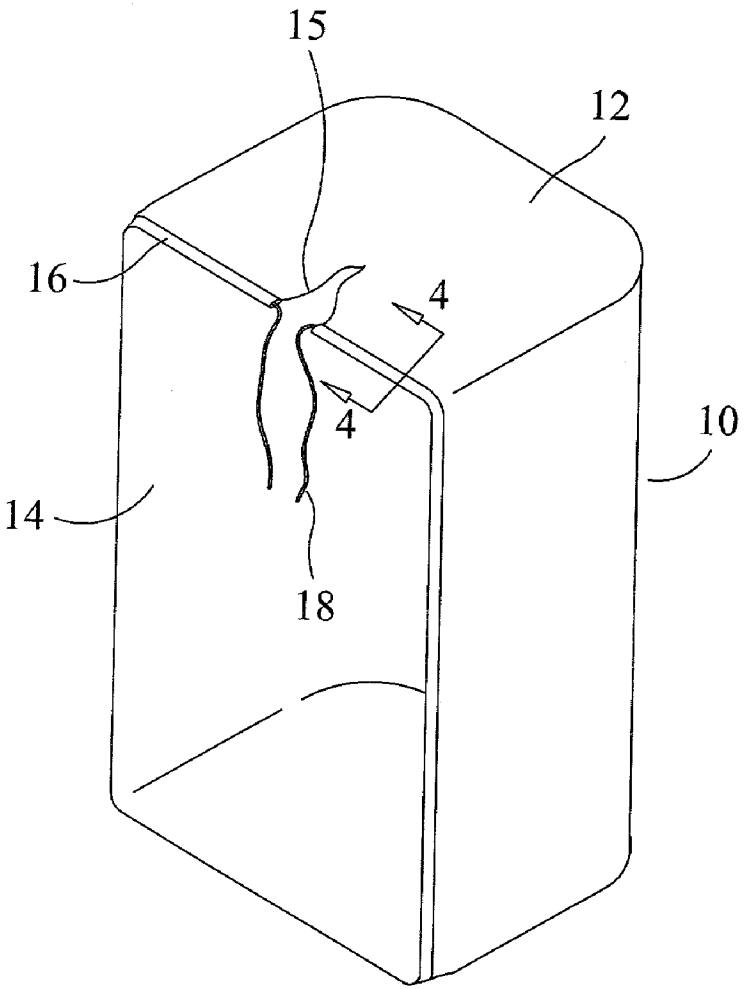
FIG. 3 is an inside perspective view of a door cover of a refrigerator conversion kit in accordance with the present invention.

With reference now to the drawings, and particularly to FIG. 1, there is shown a perspective view of a door cover 10 attached to a refrigerator unit 100. The refrigerator unit 100 is any structure that cools or keeps cool some object place therein. With reference to FIGS. 2-4, a refrigerator conversion kit includes the door cover 10. The door cover 10 preferably includes a nylon sheet that is sewn into the shape of a generally concave cap 12. However, the cap 12 could also be fabricated of a rigid material, such as molded plastic. An insulating layer 14 is attached to an inside surface of the cap 12 with adhesive, sewing or any other suitable method. An inside perimeter of the cap 12 is sized to be slipped over an outside perimeter of an open end of the refrigerator unit 100. An elastic sheet is preferably folded over and sewn around an open end perimeter of the refrigerator door cover 10 to form an elastic loop 16. A cut 15 may be formed through the elastic loop 16 and the cap 12 and a draw string 18 inserted into the elastic loop 16, such that each end of the draw string 18 extends from the cut 15. Each end of the draw string 18 extends outward from the cut 15. A shank opening 20 is formed through a front of the door cover 10 to provide clearance for a faucet shank 32.

The refrigerator conversion kit may also include a carbon dioxide bottle 22, a gas regulator 24, a sankey 26, a faucet support 28, a faucet 30, a faucet shank 32, a carbon dioxide tube 34 and a beverage tube 36. The carbon dioxide bottle 22 is filled with pressurized carbon dioxide gas. The gas regulator 24 is attached to a threaded outlet 23 of the carbon dioxide bottle 22. The sankey 26 is inserted into a tapper port 104 of a half barrel 102. One end of the carbon dioxide tube 34 is connected to an output connector 38 of the gas regulator 24 and the other end is connected to an inlet fitting 40 of the sankey 26. A thermostat relocation plate 42 is used to mount a thermostat 105 of the refrigerator unit 100 in a rear interior portion of the refrigerator unit 100, if necessary to provide clearance for the half barrel 102.

The faucet support 28 includes a hook portion 44, an offset portion 46 and a shank ring 48. The hook portion 44 is formed on one end of the faucet support 42 and the shank ring 48 is formed on the other end thereof. The offset portion 46 is formed in substantially a middle of the faucet support 28. The hook portion 44 is inserted into a handle opening 106 in the half barrel 102. The offset portion 46 is retained, under the inserted sankey 26. The faucet shank 32 is inserted through a support plate 50, the shank opening 20 in the door cover 10 and the shank ring 48. A nut (not shown) is threaded and tightened on to an end of the faucet shank 32. One end of the beverage tube 36 is secured to an outlet fitting 52 of the sankey 26 and the other end is secured to an inlet fitting 54 extending from one end of the faucet shank 32. The faucet 30 is attached to the other end of the faucet shank 32.

A regular door of a refrigerator unit (not shown) is removed, before installing the door cover 10. The door cover 10 is slipped over the open end of the refrigerator unit 100. If used, the draw string 18 is pulled tightly and tied to maintain a substantially air tight seal between the door cover 10 and the open end of the refrigerator unit 100. Pulling a handle 56 of the faucet 30 provides a refrigerated beverage from the half barrel 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A refrigerator unit beverage tapper conversion kit comprising:

a door cover including a cover cap and at least one insulating layer applied to an inside surface of said cover cap, a refrigerator door is removed from said refrigerator unit and replaced with said door cover, said door cover having means for sealing around an outer perimeter of an open end of the refrigerator unit, wherein a beverage container being is retained located in the refrigerator unit, the beverage container is too big to be completely stored in the refrigerator unit, the beverage container extending out of the open end of the refrigerator unit and into the door cover, a dispensing device being connected to the beverage container, the dispensing device being disposed on said door cover.

2. The refrigerator unit beverage tapper conversion kit of claim 1, further comprising:

a regulator for controlling the flow of pressurized gas.

3. The refrigerator unit beverage tapper conversion kit of claim 1, further comprising:

one end of a beverage tube being connected to the beverage container and the other end being connected to the dispenser device.

4. The refrigerator unit beverage tapper conversion kit of claim 1, further comprising:

said means for sealing the open end of the refrigerator unit being an elastic loop attached to an outside perimeter of said open end of said door cover.

5. The refrigerator unit beverage tapper conversion kit of claim 1, further comprising:

a thermostat relocation plate for mounting a thermostat in a rear interior portion of the refrigerator unit.

6. A refrigerator unit beverage tapper conversion kit comprising:

a door cover including a cover cap and at least one insulating layer applied to an inside surface of said cover cap, a refrigerator door is removed from said refrigerator unit and replaced with said door cover, said door cover having means for sealing around an outer perimeter of an open end of the refrigerator unit, wherein a beverage container is located in the refrigerator unit, the beverage container is too big to be completely stored in the refrigerator unit, the beverage container extending out of the open end of the refrigerator unit into the door cover, a source of pressurized gas being connected to the beverage container, a dispensing device being connected to the beverage container, the dispensing device being disposed on said door cover.

7. The refrigerator unit beverage tapper conversion kit of claim 6, further comprising:

a dispenser support having one end retained by the beverage container and the other end of said dispenser support retaining the dispensing device.

8. The refrigerator unit beverage tapper conversion kit of claim 6, further comprising:

one end of a beverage tube being connected to the beverage container and the other end being connected to the dispenser device.

9. The refrigerator unit beverage tapper conversion kit of claim 6, further comprising:

said means for sealing the open end of the refrigerator unit being an elastic loop attached to an outside perimeter of said open end of said door cover.

10. The refrigerator unit beverage tapper conversion kit of claim 6, further comprising:

a regulator for controlling the flow of pressurized gas from the source of pressurized gas.

11. The refrigerator unit beverage tapper conversion kit of claim 6, further comprising:

a thermostat relocation plate for mounting a thermostat in a rear interior portion of the refrigerator unit.

12. A refrigerator unit beverage tapper conversion kit comprising:

a door cover including a cover cap and at least one insulating layer applied to an inside surface of said cover cap, a refrigerator door is removed from said refrigerator unit and replaced with said door cover, said door cover having means for sealing around an outer perimeter of an open end of the refrigerator unit, wherein a beverage container is located in the refrigerator unit, the beverage container is too big to be completely stored in the refrigerator unit, the beverage container extending out of the open end the refrigerator unit and into said door cover, a dispensing device being connected to the beverage container, the dispensing device being disposed on said door cover, a dispenser support having one end retained by the beverage container and the other end of said dispenser support retaining the dispensing device.

13. The refrigerator unit beverage tapper conversion kit of claim 12, further comprising:

a regulator for controlling the flow of a pressurized gas to the beverage container.

14. The refrigerator unit beverage tapper conversion kit of claim 12, further comprising:

one end of a beverage tube being connected to the beverage container and the other end being connected to the dispenser device.

15. The refrigerator unit beverage tapper conversion kit of claim 12, further comprising:

said means for sealing the open end of the refrigerator unit being an elastic loop attached to an outside perimeter of said open end of said door cover.

16. The refrigerator unit beverage tapper conversion kit of claim 12, further comprising:

a thermostat relocation plate for mounting a thermostat in a rear interior portion of the refrigerator unit.

* * * * *